United States Patent [19]

Kuehn

[11] 4,047,334

[45] Sept. 13, 1977

[54] BLAST CLEANING MACHINE

[75] Inventor: Udo Kuehn, Ann Arbor, Mich.

[73] Assignee: Ervin Industries, Inc., Ann Arbor, Mich.

[21] Appl. No.: 739,954

[22] Filed: Nov. 8, 1976

[51] Int. Cl.[2] ..... B24C 3/24

[52] U.S. Cl. ..... 51/422; 134/159; 241/DIG. 10

[58] Field of Search ..... 51/9 R, 13, 164; 134/157, 159; 241/DIG. 10

[56] References Cited

U.S. PATENT DOCUMENTS

| | | | |
|---|---|---|---|
| 1,491,663 | 4/1924 | Billings | 51/13 |
| 1,934,461 | 11/1933 | Hartley | 51/164 X |
| 2,116,160 | 5/1938 | Rosenberger | 51/13 |
| 2,424,955 | 7/1947 | Potter | 51/13 |
| 3,948,003 | 4/1976 | Pletscher | 51/164 |

FOREIGN PATENT DOCUMENTS

| | | | |
|---|---|---|---|
| 543,048 | 12/1955 | Belgium | 51/13 |
| 580,226 | 8/1946 | United Kingdom | 51/13 |

*Primary Examiner*—Gary L. Smith
*Attorney, Agent, or Firm*—Olsen and Stephenson

[57] ABSTRACT

A blast cleaning machine for blast cleaning parts comprising a main frame, a housing supported on the main frame, and a barrel assembly rotatably supported in the housing for oscillatory movements therein between loading, blasting and discharge positions. The barrel assembly has an annular side wall provided with relatively inclined sections that cooperate with relatively inclined surface sections at the bottom of the barrel to provide for a continuous tumbling and flowing of parts in the barrel across a stream of shot projected into the open end of the barrel by a conventional impeller assembly. This action of the parts assures a full cleaning of all of the parts in the barrel in a relatively short time.

4 Claims, 5 Drawing Figures

BLAST CLEANING MACHINE

BACKGROUND OF THE INVENTION

The machine of this invention relates generally to the field of apparatus for cleaning the surfaces of articles such as metal castings and the like by throwing abrasive shot onto the surfaces of the articles as a batch of the articles are tumbled about in the path of the abrasive shot. Prior machines in this field have not been completely satisfactory either because the parts are not uniformly cleaned or the time and expense required to clean the parts has been too high. It is an object of the present invention, therefore, to provide an improved machine for blast cleaning the surfaces of parts.

SUMMARY OF THE INVENTION

The machine of this invention consists of a particularly constructed barrel having an open end and a longitudinal axis which extends through the open end. The barrel is movably mounted in an enclosed housing for movement to a part tumbling and blast cleaning position in which the axis is inclined upwardly and the open end of the barrel is up. An impeller is mounted on the housing so that it can impell a stream of shot into the open end of the barrel. The side walls of the barrel have angularly related surfaces that impart a tumbling and rolling action to the parts during rotation of the barrel. The barrel has a bottom surface which is divided into relatively inclined sections that also impart a rolling and tumbling action to the parts in the barrel, particulary during flow of these parts diametrically across the barrel, as seen through the open end of the barrel. The result is an agitating action to the parts in the barrel which exposes all of the surfaces of the parts directly to the stream of shot that is being thrown into the open end of the barrel thereby providing for an effective and efficient cleaning of the parts.

A hydraulically operated mechanism moves the barrel from the cleaning position to loading and dumping positions so that the cleaning of one batch of parts can readily be followed by the cleaning of a second batch. This mechanism also enables ready adjustment of the position of the barrel in the housing to adjust the machine to the cleaning of various parts.

Further objects, features, and advantages of this invention will become apparent from a consideration of the following description, the appended claims, and the accompanying drawing in which:

Figure 1:
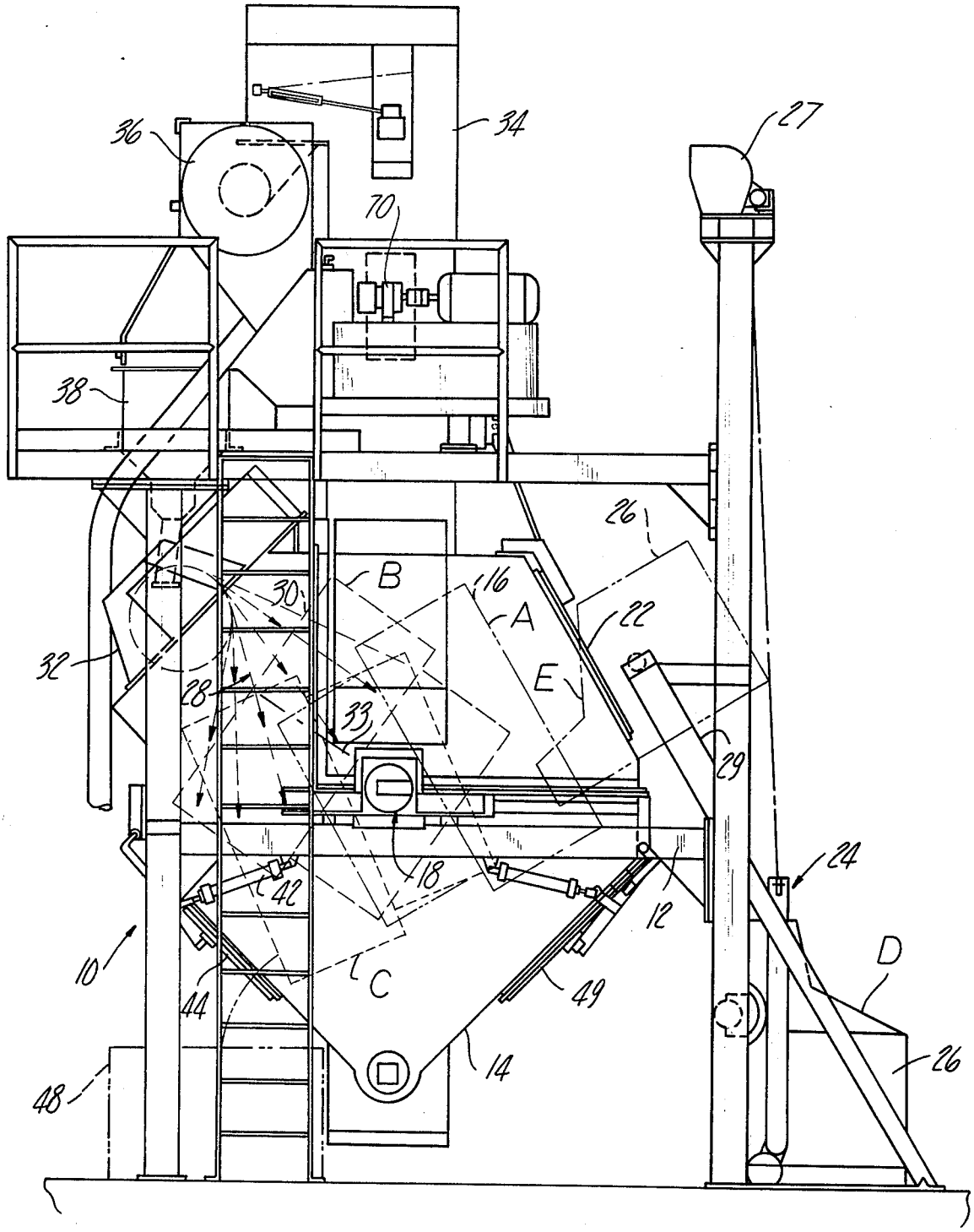
FIG. 1 is a side elevational view of the machine of the invention showing in broken lines the loading, cleaning and discharge positions of the barrel assembly in the machine.
Figure 5:
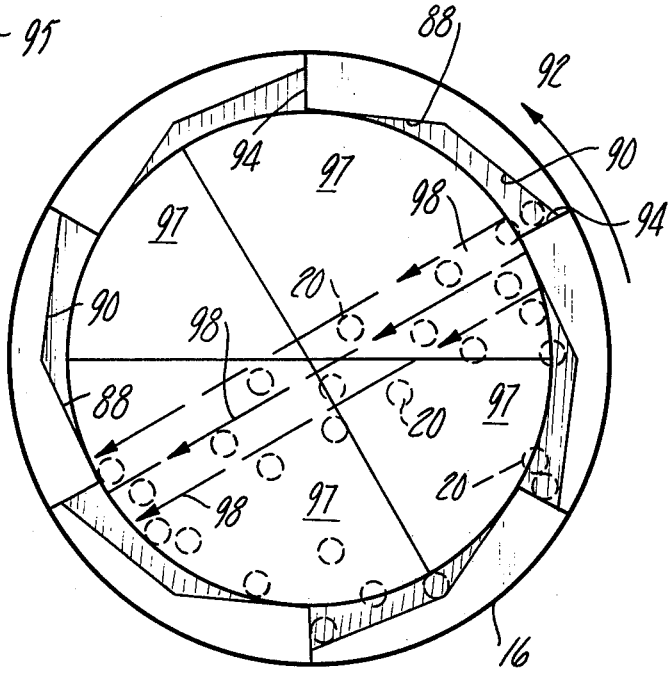
FIG. 5 is a diagrammatic end view of the barrel assembly in the machine of this invention showing the flow of parts therein during blast cleaning of the parts.

The blasting machine of this invention, indicated generally at 10 in FIG. 1, consists of a main frame 12, a housing 14 supported in a stationary position on the main frame 12, and an open top barrel assembly 16 rotatably mounted in the housing 14. The barrel assembly 16 is movable by means of a barrel positioning assembly 18 between loading, blasting and discharge positions shown in FIG. 1 at A, B, and C, respectively. When the positioning assembly 18 is operated to move the barrel assembly 16 into the loading position, shown in broken lines at A, parts to be blast cleaned, a plurality of which are shown diagrammatically at 20 in FIG. 5, are emptied into the barrel assembly 16 through a loading opening normally closed by a door 22 on the housing 14. The parts 20 are dumped into the barrel 16 by a conventional loading mechanism 24 consisting of a container 26 movable by means of a winch 27 from a filled position shown at D in FIG. 1 upwardly along a track 29 to the dump position shown in broken lines at E.

When the barrel assembly 16 and the contents thereof are moved into the blasting position, shown in dashed line at B in FIG. 1, the parts 20 are exposed to a stream 28 of shot projected through the open top 30 of the barrel 16 by a centrifugal impeller 32. The barrel 16 is rotated about its longitudinal axis 33 (FIG. 2) while in the blasting position to provide maximum exposure of the parts 20 to the stream 28. After blasting of the parts 20 is completed, shot from the stream 28 and other foreign particles, such as scale blasted off the cleaned parts, are drawn out of the housing 14 by means of a conventional elevator mechanism 34 and exposed to a separating screen and air wash system 36. Reusable shot is separated from waste products and transferred into a shot storage container 38. This shot is subsequently fed into the impeller 32.

The barrel assembly 16 is movable from the blasting position B to a discharge position shown at C in phantom lines in FIG. 1. A cylinder assembly 42 is operated to open a discharge door 44 overlying a discharge opening (not shown) in the housing 14 through which the parts 20 pass into a discharge bin 48 disposed therebelow for subsequent transport of the cleaned parts 20 to a point of use. An auxiliary discharge door 49 on the housing 14 is also usable in the event discharge of cleaned parts at a different point is desired.

Figure 2:
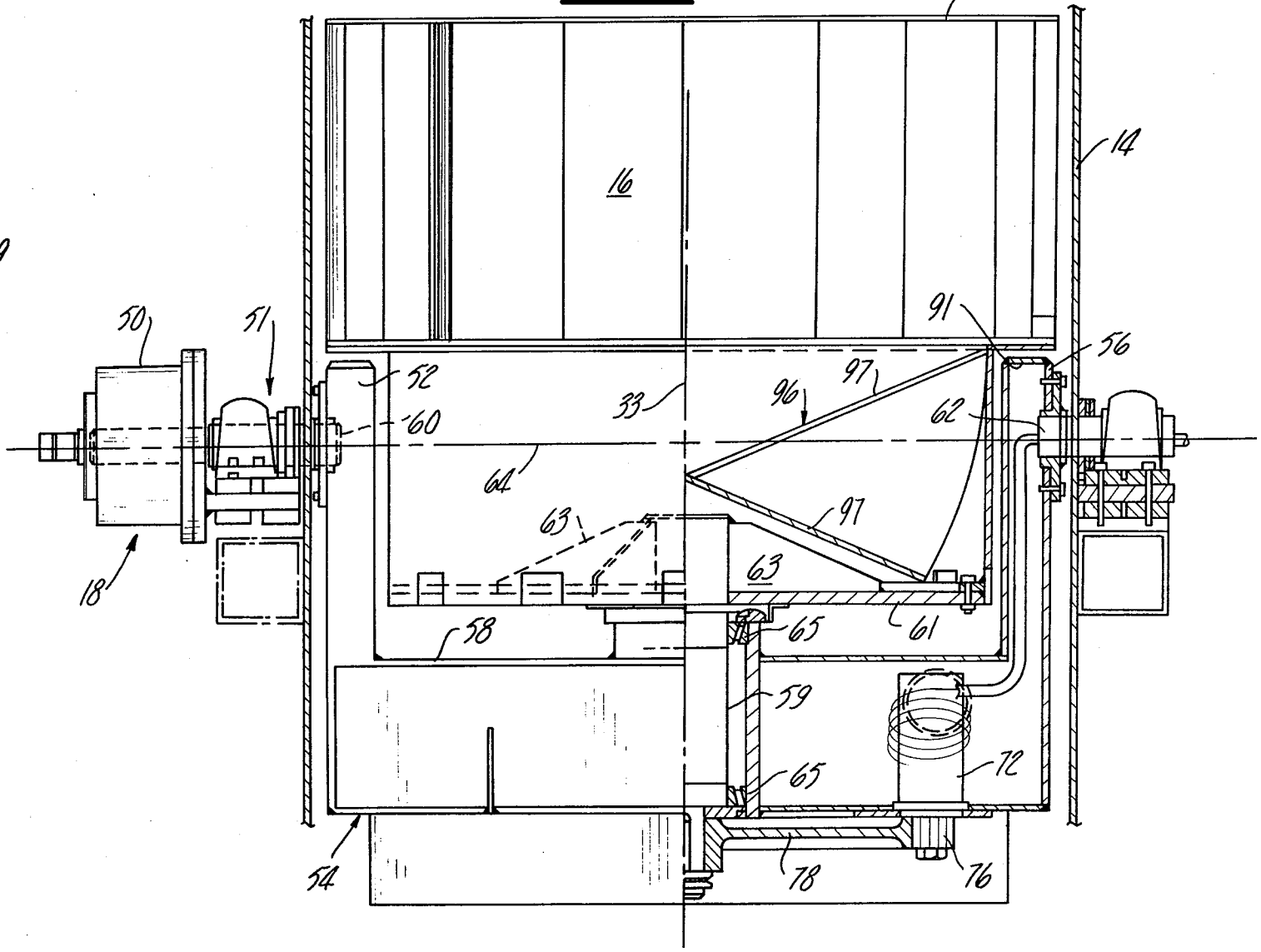
FIG. 2 is an enlarged, transverse sectional view through the barrel and the housing therefor in the machine of this invention.

As seen in FIG. 2, the barrel positioning assembly 18 consists of a hydraulic oscillator 50 and a drive mechanism 51 connected between the oscillator 50 and one leg 52 of a U-shape yoke 54. The yoke also includes another leg 56 and a base 58. The legs 52 and 56 are pivotally mounted on the housing 14 by pivot members 60 and 62, respectively, for oscillatory movement about a transverse axis 64. A shaft 59 is secured to the bottom wall 61 of the barrel 16 by a plurality of gusset plates 63. The shaft 59 is mounted in aligned bearings 65 carried by the yoke base 58 to thereby mount the barrel 16 on the yoke 54 so that the axis 33 and the shaft 59 are substantially aligned. Thus, the oscillator 50 is operable to rotate the yoke 54 and thus the barrel 16 about the axis 64 between the loading, blasting and discharge positions indicated in FIG. 1. The oscillator 50 is operable to allow slight variations in the blasting position of the barrel 16 relative to the impeller 32 to thus adapt the machine 10 to the cleaning of different parts.

The barrel 16 is rotated while in the blasting position by means of a hydraulic drive system which includes a pump and control unit shown at 70 in FIG. 1 mounted on the main frame 12. The unit 70 is connected to a fluid drive motor 72 located in the base of the yoke 54. The motor 72 drives a gear 76 which in turn drives a gear 78 secured to the shaft 59. Thus, operation of motor 72 provides for driving of shaft 59 which rotates barrel 16 about axis 33.

Figure 3:
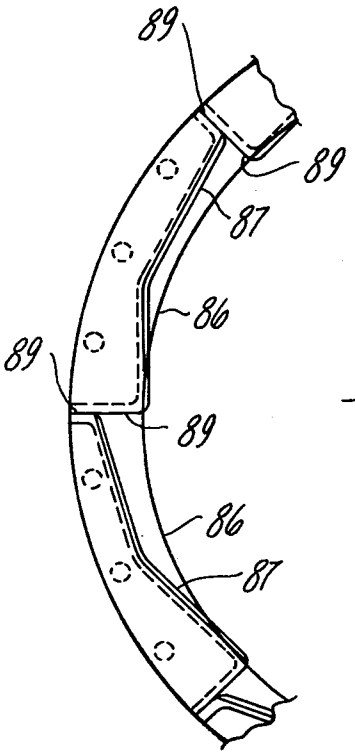
FIG. 3 is a fragmentary view of the open end of the barrel assembly in the machine of this invention.
Figure 4:
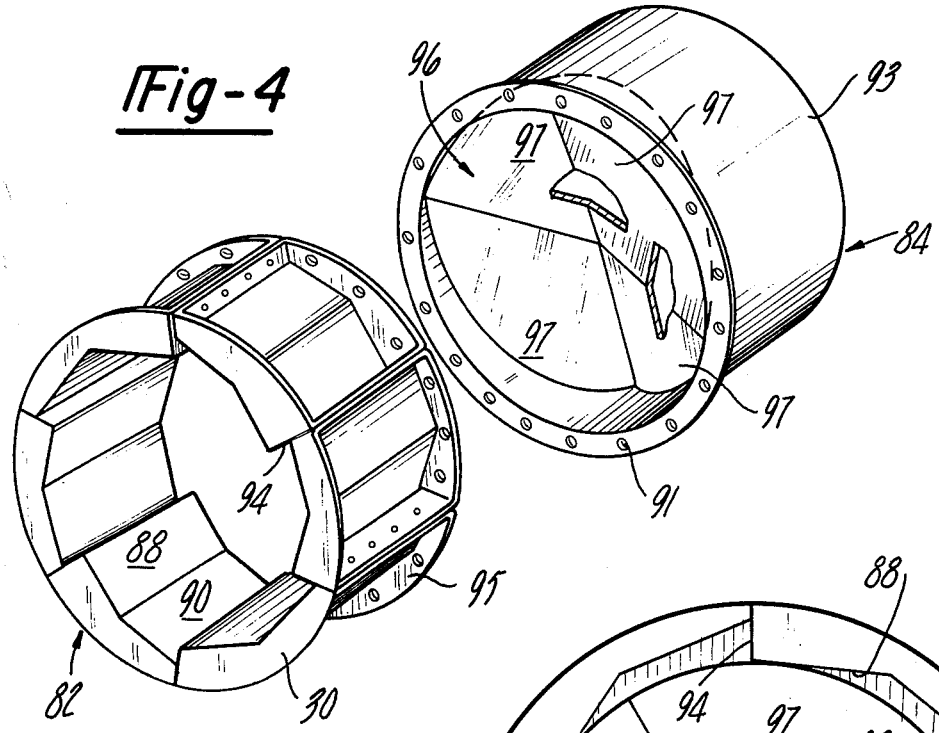
FIG. 4 is an exploded perspective view of the barrel assembly in the machine of this invention.

The barrel 16 (FIGS. 3 - 5) consists of an annular side wall assembly 82 and a separate base assembly 84. The side wall assembly 82 comprises a plurality of substantially arcuate sections 86, having inner surfaces 87 which form the inner surface of the barrel 16, and which are connected to each other and to the base 84. Each arcuate section 86 has end flanges 89 which are connected by conventional connectors, such as bolts, not shown, to the flanges 89 on the adjacent sections 86. Each inner surface 87 has a leading portion 88 and a trailing portion 90 which are substantially straight and are relatively arranged so as to form an obtuse angle therebetween, the terms "leading" and "trailing" indicating that the portion 88 is ahead of the portion 90 in the direction of rotation of the barrel 16, namely the direction of the arrow 92 in FIG. 5. The leading portion 88 terminates at the leading surface thereof in a section or lip 94 which extends radially outwardly of the barrel 16 for a purpose to appear presently.

The base assembly 84 has an annular side wall 93 which terminates at one end in the bottom wall 61 and at the opposite end in a flange 91 secured to a corresponding flange 95 on the side wall assembly 82. Between the wall 61 and the flange 91 the base 84 has a wall 96 which forms the bottom surface of the barrel 16 and supports the parts being cleaned in the barrel 16. The wall 96 is divided into four relatively inclined sections 97.

In the use of the machine 10, assume the barrel is loaded with parts to be cleaned and is in position B. The barrel 16 rotates in the direction of the arrow 92 in FIG. 5 in response to operation of the pump unit 70. The parts 20 are carried upwardly on the barrel side wall by the arcuate sections 86 until forced by gravity to drop diametrically across the barrel 16. Rotation of the barrel 16 thus provides for a flow of parts 20 in the direction of the arrows 98 in a plane perpendicular to the stream 28 of shot. Furthermore, the inclined sections 97 of the base 84 in cooperation with the relatively inclined side surfaces 88 and 90, provide a rolling and tumbling of parts 20 during rotation of the barrel 16. The rolling and tumbling parts then ride up the barrel side walls, assisted by the lip 94, and then flow in the path indicated by the arrows 98 at right angles to the shot stream 28 so as to achieve maximum utilization of the shot to clean the parts. The result is an efficient cleaning operation in which all surfaces of all the parts are cleaned.

This invention thus provides an improved blast cleaning machine 10 utilizing an improved barrel assembly 16 consisting of an annular side wall assembly 82 having a plurality of arcuate sections 86 and a separate base assembly 84 having relatively inclined surface sections 97. The side wall sections 86 and the base sections 97 cooperate during rotation of the barrel 16 to provide a continuous tumbling and flowing of parts 20 across a stream 28 of shot for shot blast cleaning thereby.

What is claimed is:

1. In a blast cleaning machine for shot blast cleaning parts, said machine having a main frame, a housing supported in a stationary position on said main frame, a barrel having an open end and a longitudinal axis extending through said end, said barrel being movably mounted in said housing for movement to a part tumbling and blast cleaning position in which said axis extends upwardly toward said open barrel end, means for rotating said barrel about the longitudinal axis thereof, and means in said housing for impelling a stream of shot into the open end of said barrel in said blasting position thereof, said barrel having an annular side wall assembly consisting of a plurality of connected arcuate sections having inner surfaces that cooperate to form the internal side wall surface of said barrel, each of said internal surfaces having leading and trailing portions which are substantially straight and are relatively arranged so as to form an obtuse angle therebetween, said leading portion being ahead of said trailing portion in the direction of rotation of said barrel during rotation thereof to tumble parts therein, said leading portion terminating in a surface portion which extends radially outwardly of said barrel at the leading end of said leading surface portion, said barrel having a bottom surface which is divided into relatively inclined sections, said side wall surface portions, and said bottom surface sections cooperating during rotation of said barrel about the longitudinal axis thereof in said blast cleaning position of said barrel to provide for a tumbling flow of parts in said barrel in a direction substantially diametrically thereof and through said stream of shot.

2. A blast cleaning machine according to claim 1 further including a generally U-shape yoke having a base and generally parallel leg sections, a barrel drive shaft secured to the bottom of said barrel in substantial alignment with the longitudinal axis thereof and rotatably supported on said base, and means pivotally supporting said leg sections on said housing to movably mount said barrel on said housing.

3. A blast cleaning machine according to claim 2 further including hydraulic motor means drivingly connected to said shaft and operable to provide for rotation thereof to in turn rotate said barrel about the longitudinal axis thereof.

4. A blast cleaning machine according to claim 3 further including hydraulic oscillator means on said housing operable to move said yoke to in turn move said barrel to other positions in which the longitudinal axis thereof is inclined to facilitate loading and unloading of said barrel.

* * * * *